United States Patent [19]

Jensen et al.

[11] 4,273,244

[45] Jun. 16, 1981

[54] CRANE UPPERSTRUCTURE SELF-TRANSFERRING SYSTEM

[75] Inventors: Lyle B. Jensen, Cedar Rapids; Leroy L. Wittman, Marion, both of Iowa

[73] Assignee: FMC Corporation, San Jose, Calif.

[21] Appl. No.: 7,102

[22] Filed: Jan. 29, 1979

[51] Int. Cl.[3] ..... B66C 23/84

[52] U.S. Cl. ..... 212/181; 212/189; 280/766; 254/86 H; 254/DIG. 1; 180/125; 414/686

[58] Field of Search ..... 212/1, 2 R, 59 R, 145, 212/66, 179–181, 184, 270; 414/686, 495, 498; 29/426, 428; 254/89 R, 89 H, 90, 86 R, 86 H, DIG. 1; 296/28 C; 180/119, 125; 280/766

[56] References Cited

U.S. PATENT DOCUMENTS

| | | | |
|---|---|---|---|
| 2,958,508 | 11/1960 | Martinez | 254/89 H |
| 3,191,706 | 6/1965 | Petersen | 180/125 |
| 3,251,479 | 5/1966 | Lonngren | 212/59 R X |
| 3,375,048 | 3/1968 | Korensky | 212/2 R |
| 3,638,805 | 2/1972 | Garnier | 212/145 X |
| 3,680,720 | 8/1972 | Strange | 212/1 X |
| 3,840,125 | 10/1974 | Cozad | 212/145 |
| 3,921,817 | 11/1975 | Petrik | 212/66 |
| 3,923,407 | 12/1975 | Jensen et al. | 212/66 X |
| 3,929,204 | 12/1975 | Newell | 212/145 X |
| 4,014,519 | 3/1977 | Leigh | 254/86 H |
| 4,018,473 | 4/1977 | Chalupsky | 296/28 C |
| 4,053,073 | 10/1977 | Franchin | 414/495 |

FOREIGN PATENT DOCUMENTS

| | | | |
|---|---|---|---|
| 2310525 | 9/1974 | Fed. Rep. of Germany | 212/145 |

*Primary Examiner*—Stephen G. Kunin
*Assistant Examiner*—Terrance L. Siemens
*Attorney, Agent, or Firm*—J. W. Edwards; J. F. Verhoeven

[57] ABSTRACT

A crane has an upperstructure that is mounted on a carrier by a quick-disconnect turntable mounting. The upperstructure can be transferred from the carrier to a transport, and back to the carrier, by a system that does not require an auxiliary crane. A live mast on the crane is used for positioning a front lift assembly and a rear lift assembly for attachment to the upperstructure. The front lift assembly is connected to the upperstructure frame by boom foot pins, and the rear lift assembly is connected to the frame by the counterweight mounting mechanism. These lift assemblies enable vertical movement of the upper structure, and outrigger jacks on the carrier enable vertical movement thereof. Air pad assemblies are provided between the outrigger jacks and the surface supporting the carrier. These air pad assemblies can also be provided between the lift assemblies and the surface supporting the upperstructure. These assemblies enable horizontal movement of either the carrier or the upperstructure with minimal frictional resistance.

10 Claims, 25 Drawing Figures

FIG_9
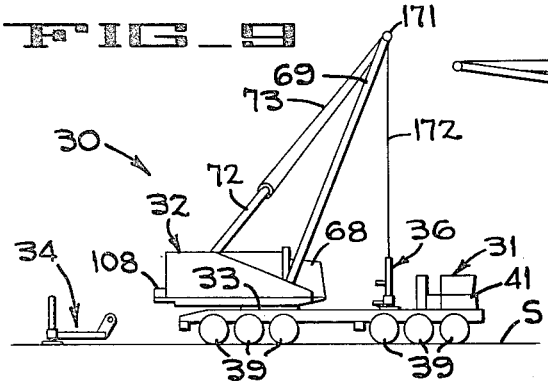
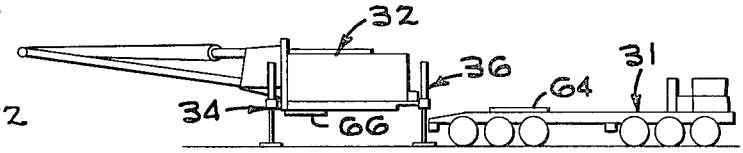
FIG_14
FIG_15
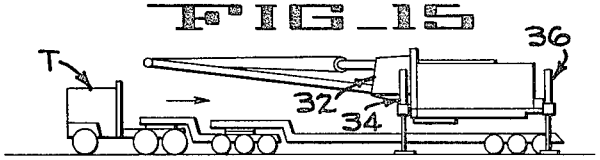
FIG_10
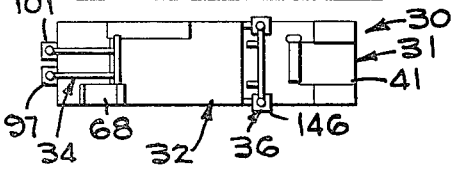
FIG_16
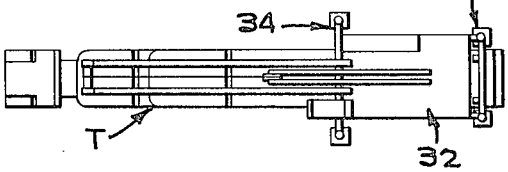
FIG_11
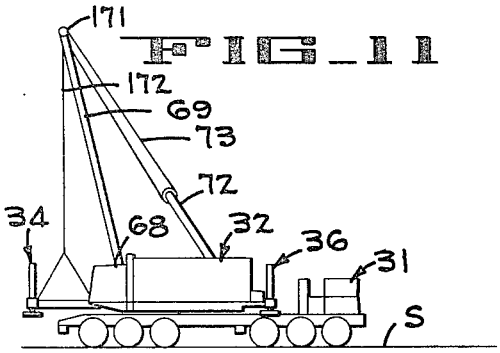
FIG_17
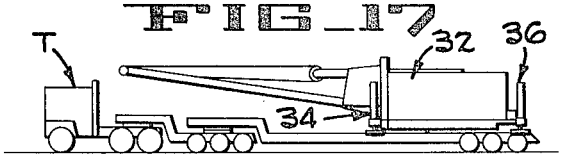
FIG_12
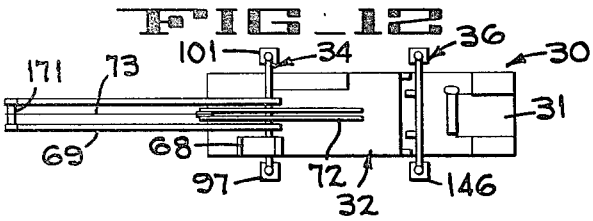
FIG_18
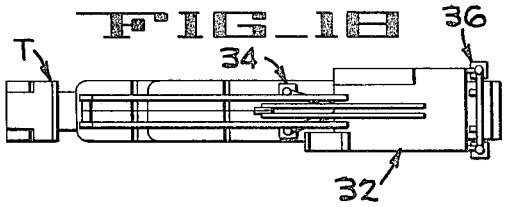
FIG_13
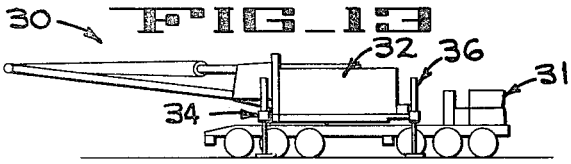
FIG_19
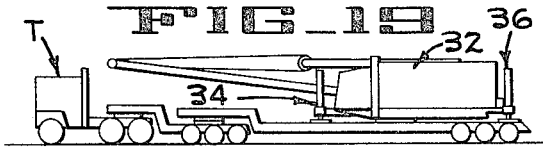

CRANE UPPERSTRUCTURE SELF-TRANSFERRING SYSTEM

BACKGROUND OF THE INVENTION

1. Field of the Invention

This invention relates to a crane upperstructure self-transferring system. More specifically, the invention is directed to a system that does not need an auxiliary crane for transferring a crane upperstructure between a carrier that is used for traveling to a job site and a transport vehicle that is used for long-haul traveling between job sites.

2. Description of the Prior Art

Because of the size and weight of large cranes, it is often necessary to disassemble the cranes to transport them from one job site to another. Such disassembly is accomplished by removing the crane upperstructure from the crane lowerstructure or carrier on the job site. The crane upperstructure is then transferred to a vehicle for transport between job sites. Upon arriving at the new job site, it is necessary to transfer the crane upperstructure from the transport back to the carrier. Such transferring of the crane upperstructure can be done with an auxiliary crane, but sometimes the only crane at a job site will be the crane to be transferred. Thus, a self-transferring system is needed for the crane upperstructure.

U.S. Pat. No. 3,923,407 that issued on Dec. 2, 1975, to Jensen et al shows a mechanism for connecting and disconnecting crane sections. Removable jacks are shown for raising or lowering a crane upper section above a base section. There is no disclosure as to how the jacks are positioned or connected relative to the crane upper section. U.S. Pat. No. 3,921,817 that issued on Nov. 25, 1975, to Petrik et al shows another mechanism for connecting and disconnecting crane sections.

U.S. Pat. No. 2,958,508, that issued on Nov. 1, 1960, to Martinez, shows a device for lifting a heavy equipment body above a tractor with jacks and cross-beams. A pair of U-bolts that are fitted upon one cross-beam engage pins at the front end of the body, and a pair of bracket arms that are fitted upon the other cross-beam engage the rear end of the body.

U.S. Pat. No. 3,191,706, that issued on June 29, 1965, to Petersen, shows a vertical jack that is supported by a tripod. Air pads are located at the base of each leg of the tripod. These air pads enable the jack to be moved laterally over uneven ground for aligning the jack on a vertical line beneath a lifting pad on an aircraft to be weighed.

U.S. Pat. No. 3,638,805, that issued on Feb. 1, 1972, to Garnier, shows a mobile chassis for carrying a tower crane. Outrigger supports are pivotally mounted to the crane frame. These supports are pivoted inward towards the frame so that the crane can be legally moved over a highway. At a job site, the outrigger supports are pivoted outward to a fully extended position providing maximum support against overturning forces on the crane.

U.S. Pat. Nos. 3,840,125, that issued on Oct. 8, 1974, to Cozad, and 4,014,519, that issued on Mar. 29, 1977, to Leigh, show outrigger jacks mounted on a carrier for a truck crane. U.S. Pat. No. 3,375,048, that issued on Mar. 26, 1968, to Korensky et al, shows a counterweight mounting mechanism, U.S. Pat. No. 4,018,473, that issued on Apr. 19, 1977, to Chalupsky, shows a crane operator's cab that can be raised and lowered.

SUMMARY OF THE INVENTION

In accordance with the present invention, there is provided a crane upperstructure self-transferring system. A crane upperstructure frame has front and rear ends. A front lifting assembly is attachable to the front end of the frame, and a rear lifting assembly is attachable to the rear end of the frame. The front lifting assembly is attached to the frame by boom foot pins mounted thereon, and/or the rear lifting assembly is attached to the frame by a counterweight mounting mechanism.

In a preferred embodiment of the invention, a carrier supports the crane upperstructure frame. A quick-disconnect turntable mounting interconnects the carrier and the frame for rotation of the frame about a generally vertical axis. Outrigger support jacks are provided for both the carrier and the crane upperstructure frame enabling either to be moved vertically independently of the other. The jacks have floats and air pad assemblies can be positioned between the floats and the ground surface supporting the floats. These air pad assemblies enable lateral movement of the carrier and/or the crane upperstructure frame to align both the carrier and the frame with the generally vertical axis of the quick-disconnect turntable mounting.

BRIEF DESCRIPTION OF THE DRAWINGS

FIGS. 9–25 are operational views illustrating the procedure in transferring a crane upperstructure from its carrier to a transport and back to its carrier.

DESCRIPTION OF THE PREFERRED EMBODIMENT

Figure 1:
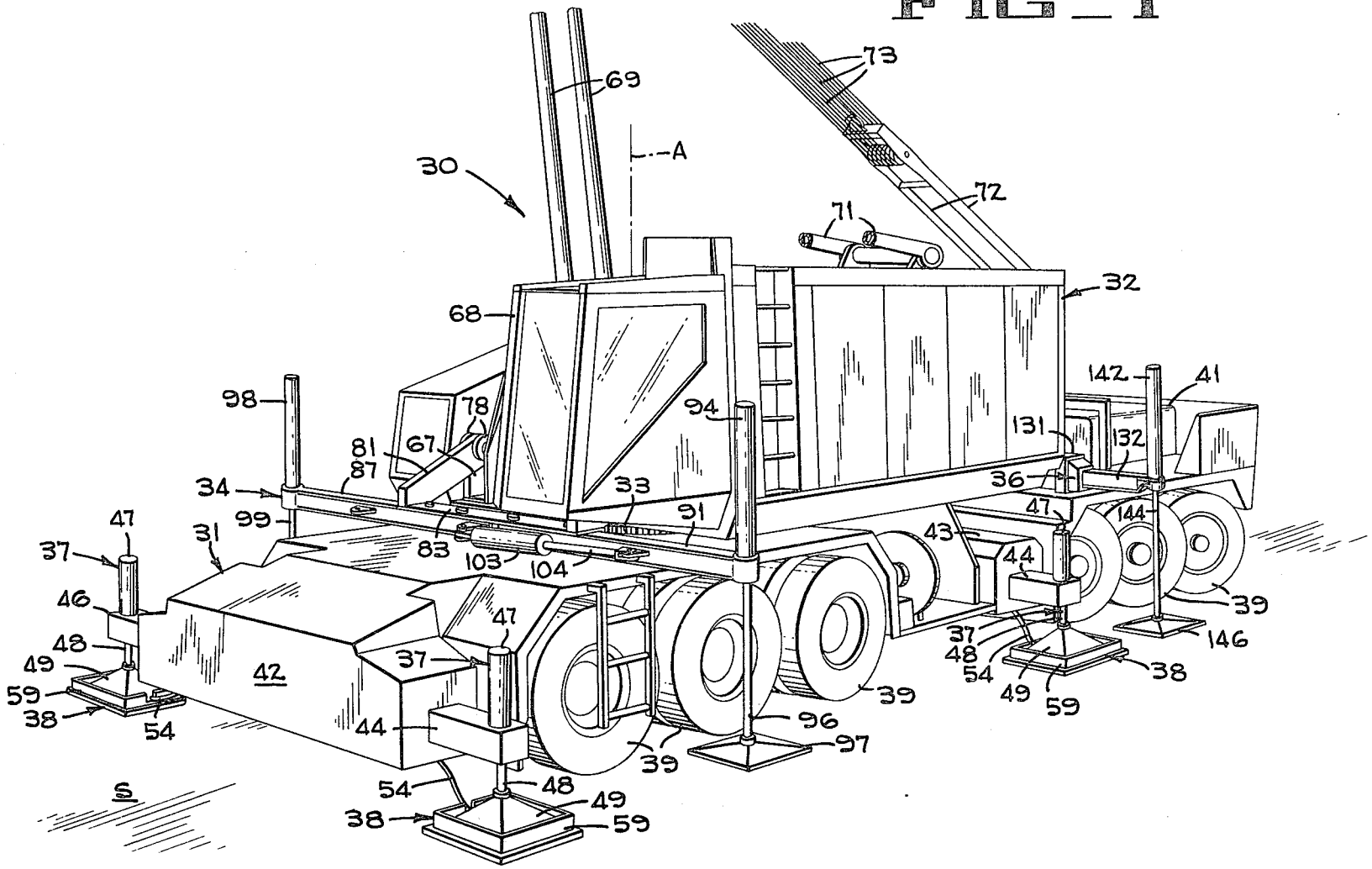
FIG. 1 is a perspective view of a crane with an upperstructure self-transferring system embodying the present invention.

Looking now at FIG. 1, a crane 30 has a carrier 31 and an upperstructure 32. The upperstructure and carrier are interconnected by a quick-disconnect turntable mounting 33 (FIG. 1) that enables the upperstructure to rotate relative to the carrier about a generally vertical axis A. To transfer the upperstructure from the carrier, there is provided a front lift assembly 34 and a rear lift assembly 36. These lift assemblies move the upperstructure vertically above the carrier and they support the upperstructure as the carrier is withdrawn from thereunder. When remounting the upperstructure upon the carrier, it is necessary to align the carrier both vertically and horizontally for interconnecting the quick-disconnect turntable mounting. The carrier has removable outrigger jacks 37 that provide for vertical movement of the carrier, and these jacks are supported upon air pad assemblies 38 that provide for horizontal movement of the carrier with minimum frictional resistance.

The carrier 31 has a set of wheels 39, but it should be understood that other motive means, such as a pair of endless crawler tracks, could be used in place of the wheels. Controls for driving the carrier are located at a front end 41 thereof. Outrigger jack support boxes 42 and 43 are attached to the carrier. An arm 44 extends from one end of each box and an arm 46 extends from the opposite end. These arms can be extended from the boxes or retracted therein. Details of such outrigger jack support boxes and extensible arms are shown in U.S. Pat. No. 3,840,125 that issued on Oct. 8, 1974, to Cozad. An outrigger jack 37 is mounted near the distal end of each arm. Such jacks can be detached when they are not needed, or they can be left in place at the ends of the arms. These jacks include hydraulic cylinders 37 with actuating arms 48 and floats 49 mounted at the distal ends of the actuating arms. Details of typical outrigger jacks are shown in U.S. Pat. No. 4,014,519 that issued on Mar. 29, 1977, to Leigh.

Figure 2:
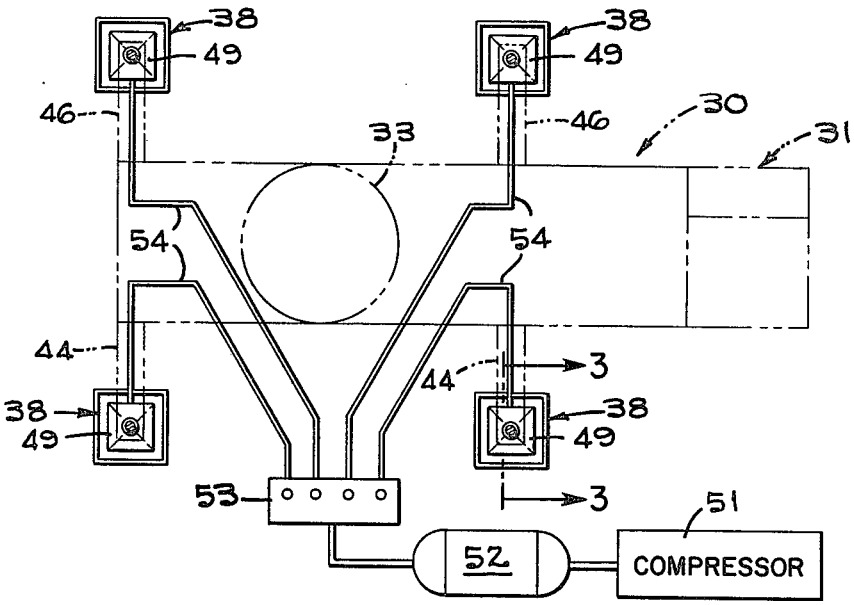
FIG. 2 is a schematic diagram of a pneumatic circuit for the crane shown in FIG. 1.

The air pad assemblies 38 are positioned between the outrigger jack floats 49 and a support surface S upon which the carrier 31 travels. As shown schematically in FIG. 2, the four air pad assemblies are connected to a pneumatic circuit. A compressor 51 supplies air under pressure to an accumulator tank 52 that feeds a manual air control console 53. Four lines 54 extend individually from the console to supply each of the four air pad assemblies. It will be understood that the compressor, accumulator tank, control console and lines will be mounted upon the carrier 31, but these elements have been spread out to schematically illustrate the pneumatic circuitry in FIG. 2.

Figure 3:
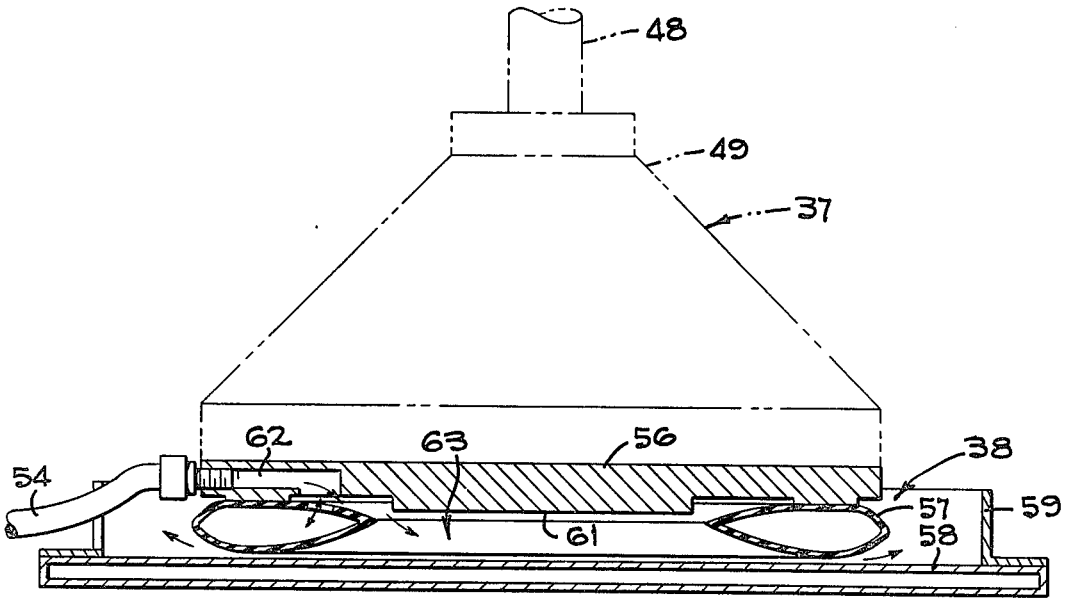
FIG. 3 is an enlarged section, taken on the line 3—3 of FIG. 2, illustrating an air pad assembly for supporting a carrier of the crane shown in FIG. 1.

As shown in FIG. 3, the air pad assemblies 38 include a mounting plate 56 that is attached to the bottom of the float 49. An inflatable torus bag 57 is attached to the bottom of the mounting plate. This bag is located above a smooth operating surface 58, such as polished stainless steel, within a retainer box 59. Before inflating the torus bag, load on the float is transferred by direct bearing between a landing pad portion 61 of the mounting plate and the smooth operating surface of the retainer box. Air from the line 54 flows through an opening 62 in the mounting plate. A portion of the air inflates the torus bag, and another portion of the air fills the plenum chamber 63. When the air pressure in the plenum chamber causes an upward force that exceeds the total load on the float, the torus bag will float upward from the smooth operating surface of the retainer box. In this levitated condition, the carrier 31 can be readily moved horizontally with minimum frictional resistance.

The air pad assemblies 38 are standard commercial items. A suitable assembly is manufactured by Aero Go, Inc., P.O. Box 80183C, Seattle, Wash. 98108, U.S.A., and sold under the trademark Aero-Caster.

The quick-disconnect turntable mounting 33 (FIG. 1) that interconnects the upperstructure 32 and the carrier 31 can be similar to the mechanism disclosed in U.S. Pat. No. 3,923,407 that issued on Dec. 2, 1975, to Jensen et al. Another suitable mechanism is disclosed in U.S. Pat. No. 3,921,817 that issued on Nov. 25, 1975, to Petrik et al. The mounting includes a turntable bearing 64 that is bolted to the carrier and an adaptor 66 that is bolted to the upperstructure, as shown in FIG. 14.

Figure 4:
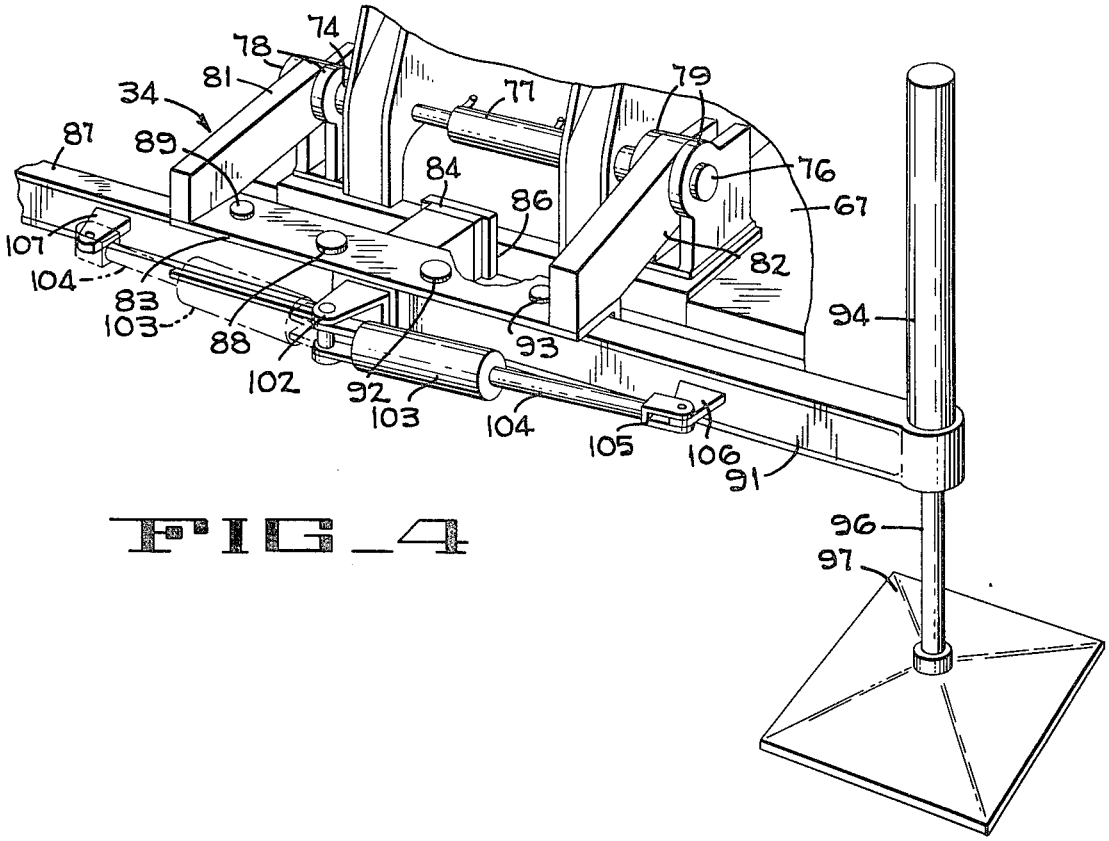
FIG. 4 is a fragmentary perspective view of a front lifting assembly for an upperstructure frame of the crane shown in FIG. 1.
Figure 5:
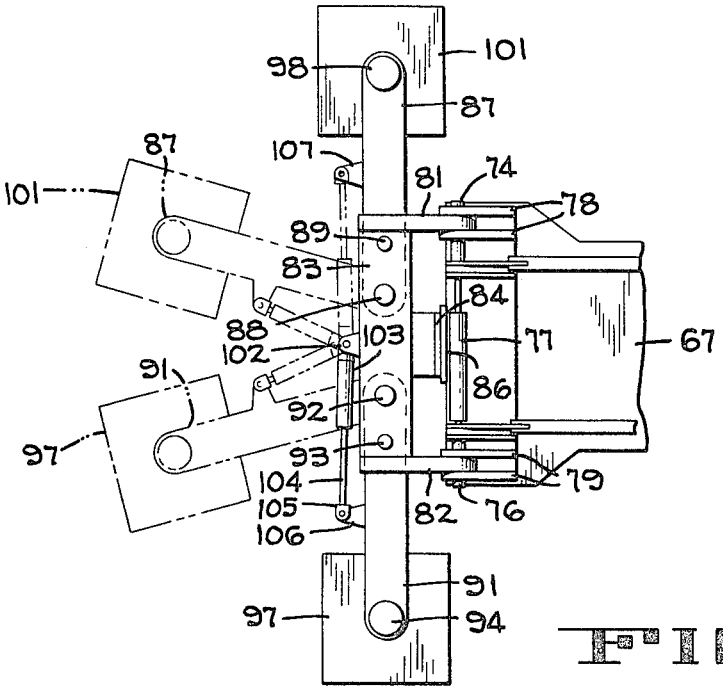
FIG. 5 is a reduced plan view of the front lifting assembly shown in FIG. 4.

The upperstructure 32 has a frame 67, that is almost obscured by other upperstructure in FIG. 1. A similar frame, with the other upperstructure removed, is shown in FIGS. 4 and 5 of U.S. Pat. No. 4,018,473 that issued on Apr. 19, 1977, to Chalupsky. This frame revolves about the axis A. The frame supports a mounting, as disclosed in the last mentioned patent, for raising or lowering a crane operator's cab 68. A live mast 69 is mounted upon the frame. Boom stops 71 are mounted upon the upperstructure along with bail anchors 72 from which wire ropes 73 extend to the distal end of the live mast.

In FIG. 1, the upperstructure 32 has been rotated 180° about the vertical axis A so that the front end of the upperstructure faces in the opposite direction from the front end 41 of the carrier 31. The crane boom, not shown, has been removed from the upperstructure, and the front lift assembly 34 is attached to the upperstructure frame 67 by the boom foot pins 74 and 76, shown more clearly in FIGS. 4 and 5. These boom foot pins are removed or inserted by a double acting hydraulic cylinder 77 that is permanently mounted between the boom foot lugs 78 and 79 on the upperstructure frame.

The front lift assembly 34 has inclined braces 81 and 82 with upper ends that attach to the boom foot pins 74 and 76. The lower ends of the braces are welded to an upper flange of a channel 83. A brace 84 that extends horizontally from the channel web has a vertical bearing surface 86 that abuts a vertical face of the upperstructure frame 67. An outrigger arm 87 is mounted by a pivot pin 88 within the channel. This arm can be locked against pivotal movement by a locking pin 89. Similarly, an outrigger arm 91 is pivotally mounted by a pivot pin 92 within the channel, and this arm can be locked in place by a locking pin 93.

Mounted at the distal end of the outrigger arm 91 is a jack cylinder 94, from which a rod 96 depends to a float 97. Similarly a jack cylinder 98, shown in FIG. 1, is mounted at the distal end of the outrigger arm 87, and a rod 99 extends downward from this cylinder to a float 101, shown in FIG. 5.

The outrigger arms 87 and 91 can be manually pivoted to the transport mode, shown in phantom line in FIG. 5, by removing the locking pins 89 and 93, but preferably power is provided for pivotal movement of the arms. Projecting from the channel 83 is a bracket 102. A hydraulic cylinder 103 has one end pivotally attached to the bracket and an opposite end from which an actuating arm 104 extends. A clevis 105, that is mounted at the distal end of the actuating arm, can be attached to either an ear 106 projecting from the outrigger arm 91 or an ear 107 projecting from the outrigger arm 87. One outrigger arm is pivoted by the hydraulic cylinder. Then the clevis is disconnected from one ear and attached to the other ear for pivoting the other outrigger arm.

Figure 6:
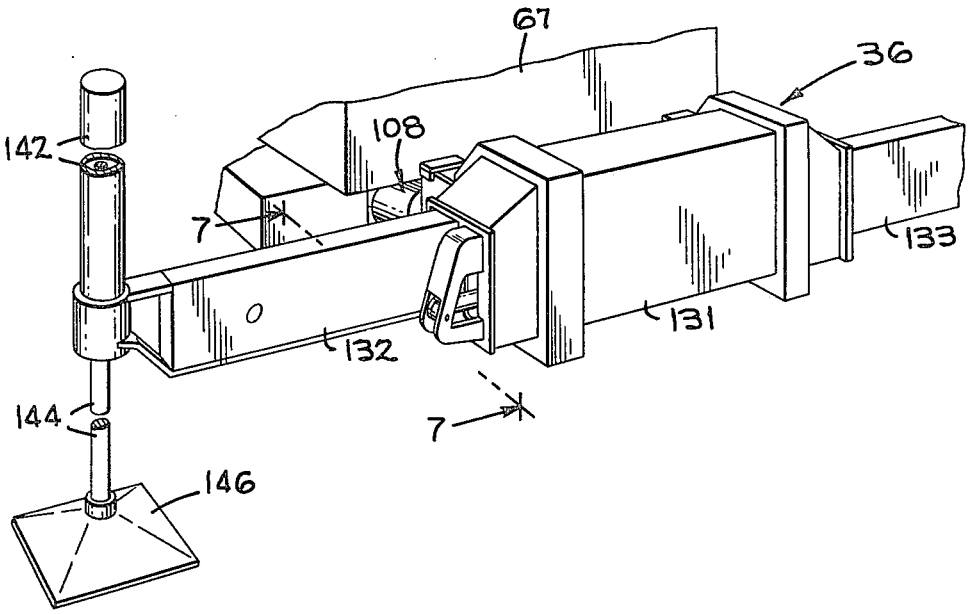
FIG. 6 is a fragmentary perspective view of a rear lifting assembly for the upperstructure frame of the crane shown in FIG. 1.
Figure 7:
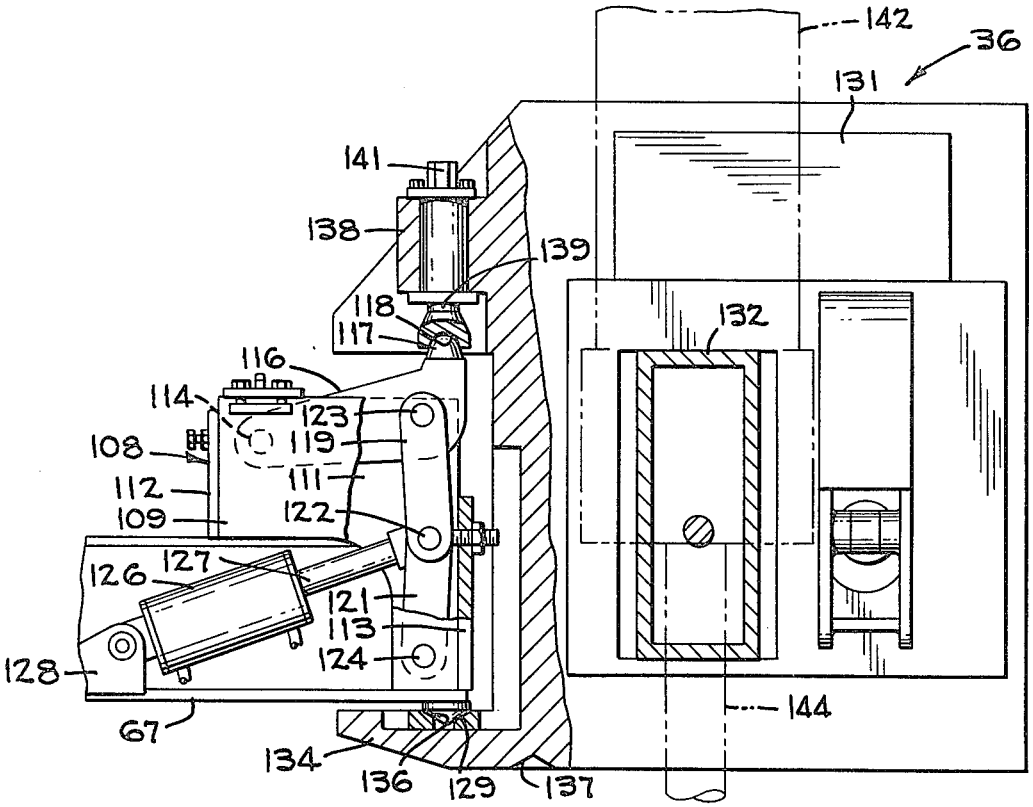
FIG. 7 is a section taken on the line 7—7 of FIG. 6.

The rear lift assembly 36 is attached to the rear end of the upperstructure frame 67 by a counterweight mounting mechanism 108, shown in FIGS. 6 and 7. This mechanism is similar to that disclosed in U.S. Pat. No. 3,375,048, that issued on Mar. 26, 1968, to Korensky et al. There are a pair of mechanisms mounted at opposite sides of the upperstructure frame. While only one mechanism is shown in FIGS. 6 and 7, it will be understood that another mechanism, identical to the mechanism shown, is mounted on the opposite side of the upperstructure frame, and these mechanisms act together as a unit.

Each counterweight mounting mechanism 108 includes a pair of laterally spaced side members 109 and 111 which are interconnected by a front member 112 and a back member 113. These members are mounted at a rear corner of the frame 67. A pair of laterally spaced bearing blocks, not shown, are adjustably mounted between the side members. A rotatable pin 114 extends between the bearing blocks. An L-shaped member 116 has one end mounted upon the pin and another end that terminates in a conically formed head portion 117. This head portion is adapted to engage a corresponding recess 118 in the rear lift assembly 36.

A pair of toggle links 119 and 121 have their adjacent ends pivotally connected together by a pin 122. The upper end of the top link 119 is pivotally connected to the member 116 by a pin 123. The lower end of the bottom link 121 is pivotally connected between the side members 109 and 111 by a pin 124 extending therebetween. The power for operating the counterweight mounting mechanism 108 is supplied by a double acting hydraulic cylinder 126 from which a piston rod 127 extends. The base end of the cylinder is pivotally connected to a bracket 128 mounted on the frame 67. The outer end of the piston rod is pivotally connected by the pin 122 to the toggle links 119 and 121. A conical shaped boss 129 projects downwardly from the frame 67.

The rear lift assembly 36 has a box 131 in which two side-by-side outrigger arms 132 and 133 are slidably received. A bottom flange 134, that projects forward from the box, has a frusto conical recess 136 on its upper surface for receiving the associated conical shaped boss 129. A conical recess 137 is formed in the lower surface of the bottom flange for use in conjunction with a complementary cone, not shown, that projects upwardly from the carrier 31 for positioning and supporting the rear lift assembly thereon. A lug 138 projects forward from the box and a stud 139 is threadedly mounted therein. A hexagonal shaped head 141 is provided at the upper end of the stud. The lower end of the stud is flared and has the recess 118 therein for receiving the head portion 117 of the L-shaped member 116.

The outrigger arms 132 and 133 can be extended from or retracted into the box 131. Details of these arms within the box are similar to those shown in U.S. Pat. No. 3,840,125 that issued on Oct. 8, 1974, to Cozad. A hydraulic jack cylinder 142 is mounted near the distal end of the arm 132, and a hydraulic jack cylinder 143 (FIG. 8) is mounted near the distal end of the arm 133. These hydraulic jack cylinders have depending piston rods 144 with floats 146 attached at the bottom ends.

It will be understood that air pad assemblies 38 could also be provided between the supporting ground surface and the floats 97, 101 and 146. Thus, the upperstructure 32 could be moved in a horizontal plane to align the vertical axis A of the quick-disconnect turntable mounting 33 for interconnecting the upperstructure and the carrier 31.

Figure 8:
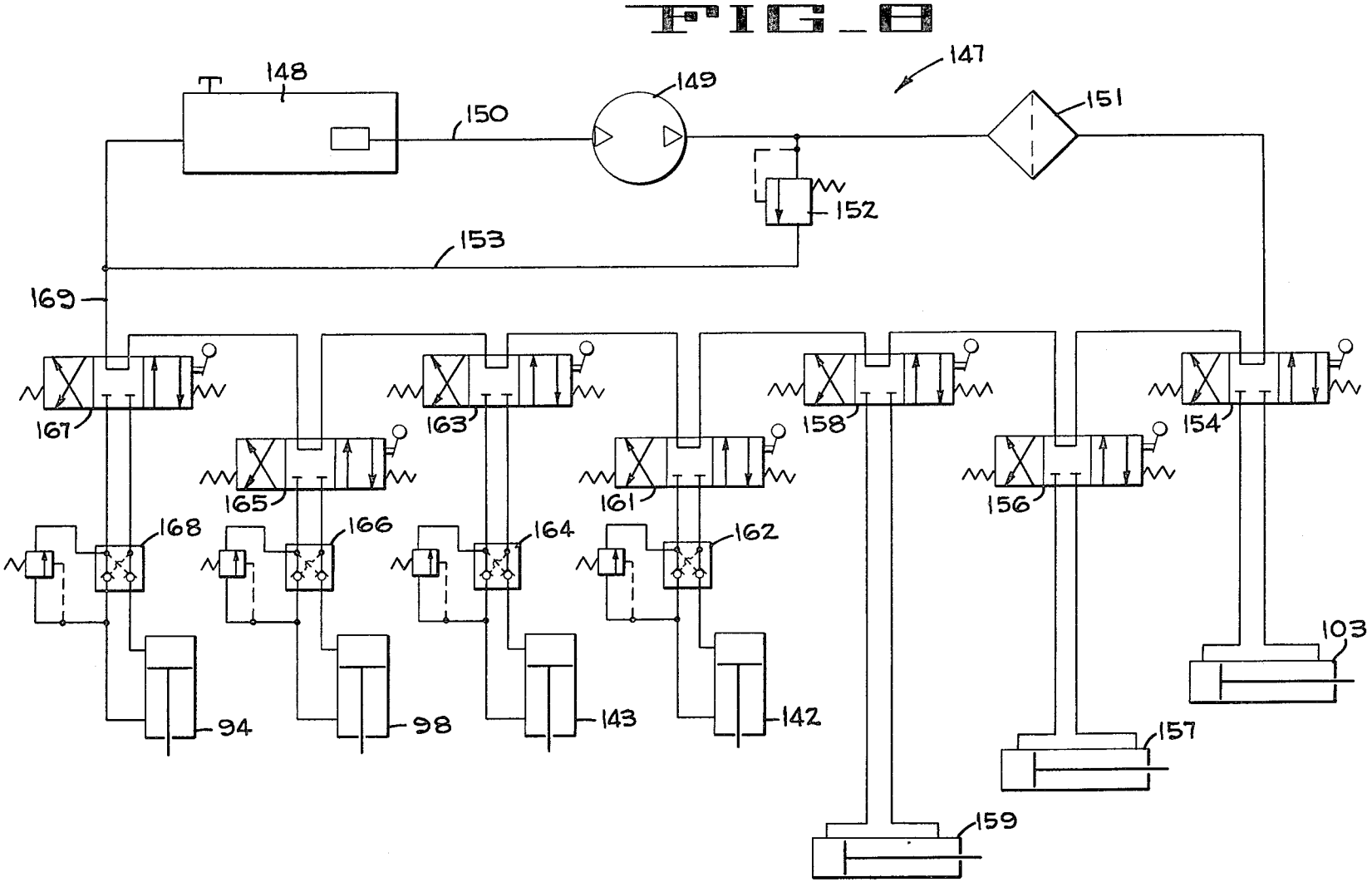
FIG. 8 is a schematic diagram of a hydraulic circuit for operating front and rear lifting assemblies.

A hydraulic circuit 147, shown in FIG. 8, operates both the front lift assembly 34 and the rear lift assembly 36. A sump tank 148 provides a source of hydraulic fluid that is drawn by a pump 149 through a line 150 and forced through a filter 151. A pressure relief valve 152 is provided in a relief line 153 that extends from between the pump and the filter back to the sump tank. On the opposite side of the filter, fluid flows to a manual control valve 154 that operates the hydraulic cylinder 103 for pivoting the outrigger arms 87 and 91.

From the valve 154, fluid flows through a manual control valve 156 that operates a hydraulic cylinder 157. This cylinder extends or retracts the outrigger arm 132 from the box 131. From the valve 156, fluid flows through a manual control valve 158 that operates a hydraulic cylinder 159 to extend or retract the outrigger arm 133. Fluid flows from the valve 158 to a manual control valve 161 that operates the hydraulic jack cylinder 142 at the left rear of the upperstructure 32. A locking valve and pressure relief circuit 162 is provided between the valve 161 and the cylinder 142. Fluid flows from the valve 161 to a manual control valve 163 that operates the hydraulic jack cylinder 143 at the right rear of the upperstructure 32. A locking valve and pressure relief circuit 164 is located between valve 163 and the cylinder 143.

Fluid flows from the valve 163 to a manual control valve 165 that operates the right front outrigger jack cylinder 98 through a locking valve and pressure relief circuit 166. From the valve 165, fluid flows to a manual control valve 167 that operates the left front outrigger jack cylinder 94 through a locking valve and pressure relief circuit 168. Fluid from the valve 167 returns through a line 169 to the relief line 153 that returns to the sump 148.

In operation, with reference to FIG. 9, the upperstructure 32 is mounted upon the carrier 31, and the crane boom is removed. An auxiliary lifting sheave 171 is mounted at the distal end of live mast 69, and a load line 172 is trained about this sheave and is powered by a conventional hoist (not shown). The rear lifting assembly 36 is lifted by the load line and placed upon the carrier with the conical recess 137 (FIG. 7) resting upon the complementary cone, not shown, on the carrier. The upperstructure is then rotated 180° on the quick-disconnect turntable mounting 33 to the position shown in FIGS. 10 and 11 so that the boss 129, shown in FIG. 7, and the head portion 117 are in a position to operatively engage their associated recesses 136 and 118 respectively. It will be understood that the rod 127 is retracted into the hydraulic cylinder 126 when the upperstructure is rotated into position.

Then, to lift the rear lift assembly 36 to the upperstructure frame 67, the hydraulic cylinder 126 is actuated to extend the rod 127 outward, urging the toggle links 119 and 121 into near vertical alignment with one another, as shown in FIG. 7. This causes the head portion 117 to move upwardly, lifting the rear lift assembly off the carrier 31 and raising it to the upperstructure frame 67. As shown in FIG. 11, the load line 172 is attached to the front lift assembly 34 that is positioned to be engaged by the boom foot pins 75 and 76, shown in FIG. 4. The hydraulic circuit 147 is connected, as shown in FIG. 8.

The operator's cab 68 is elevated, as shown in FIGS. 12 and 13. The outrigger arms 87 and 91, shown in FIG. 1, are pivoted by the hydraulic cylinder 103 to the laterally extended positions shown, and the pontoons 97 and 101 are lowered to engage the surface S. The outrigger arms of the rear lift assembly 36 are extended and the floats 146 are lowered to engage the surface S. The quick-disconnected turntable mounting 33 is unlocked. The upperstructure 32 is elevated by the front lift assembly 34 and the rear lift assembly 36, and the carrier 31 is driven out from under the upperstructure, as shown in FIG. 14.

A transport T is backed beneath the upperstructure 32, as shown in FIG. 15, and the upperstructure is lowered onto the trailer where it is secured in place. The outrigger jacks of the front lift assembly 34 and the rear lift assembly 35 are retracted, as are the outrigger arms 132 and 133 of the rear lift assembly, as shown in FIGS. 16 and 17, and the floats 146 can be removed if desired. The outrigger arms 87 and 91 of the front lift assembly are pivoted forwardly to the transport mode, shown in FIGS. 18 and 19, and the operator's cab 68 is lowered. The transport then carries the upperstructure to a job site, and the carrier 31, without the upperstructure, can be driven over a highway.

Figure 20:
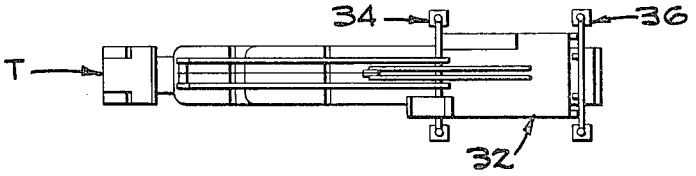
Figure 21:
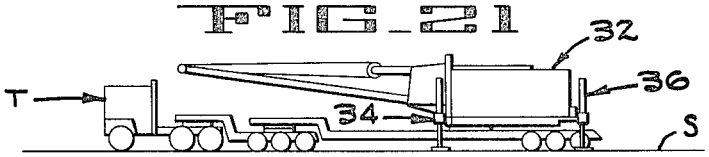
Figure 22:
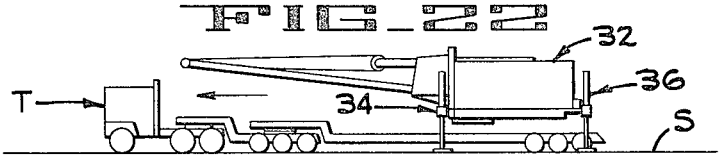

To reassembly the crane 30, the operator's cab 68 is elevated and the outrigger arms of the front lift assembly 34 and the rear lift assembly 36 are extended laterally outward from the upperstructure 32, as shown in FIG. 20. The floats 146 are reinstalled on the rear lift assembly if they had been removed, and the pivotal arms of the front lift assembly are locked. All tie-downs between the upperstructure and the transport T are removed. The lift assemblies are actuated to elevate the upperstructure from the transport, as shown in FIG. 22, and the transport is driven from beneath the upperstructure.

Figure 23:
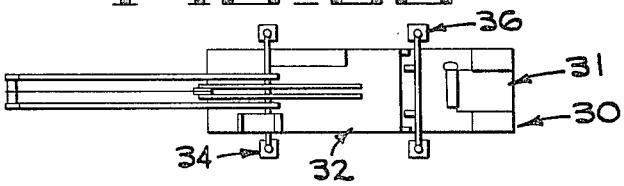
Figure 24:
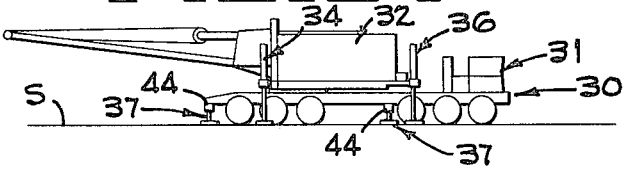

The carrier 31 is backed beneath the upperstructure 32, as shown in FIGS. 23 and 24. The carrier outrigger arms 44 and 46 are extended and the outrigger jacks 37 are lowered. The air pad assemblies 38 contact the surface S. The carrier or the upperstructure is moved horizontally so that the vertical axis A of the quick-disconnect turntable mounting 33 is aligned with both the upperstructure and the carrier. Then, the upperstructure is lowered onto the carrier. The quick-disconnect turntable mounting 33 is locked. The outrigger jacks of the front lift assembly 34 and the rear lift assembly 36 are retracted, as are the outrigger arms 132 and 133 of the rear lift assembly. The fron lift assembly is unpinned and removed by the load line 172 that depends from the live mast 69.

Figure 25:
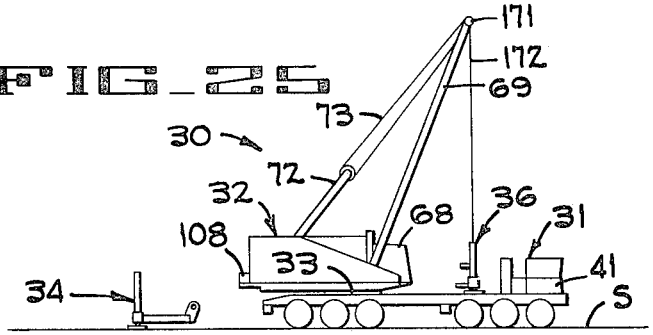

The rear lift assembly 36 is lowered by the counterweight mounting mechanism 108 onto the carrier 31. The upperstructure 32 is rotated 180° about the axis A. Then, this assembly is removed by the load line 172 depending from the live mast 69. The operator's cab 68 is lowered, as shown in FIG. 25.

From the foregoing description, it will be seen that a system is provided for transferring a crane upperstructure 32 from its carrier 31 to a transport T and back to the carrier without need for an auxiliary crane. A front lift assembly 34 and a rear lift assembly 36 are positioned with the aid of the live mast 69 for attachment to the upperstructure. The front lift assembly is pinned by the boom foot pins 74 and 76 to the upperstructure frame 67, and the rear lift assembly is mounted on the frame by the counterweight mounting mechanism 108. The lift assemblies enable vertical movement of the upperstructure. A quick-disconnect turntable mounting 33 interconnects the carrier and the frame in alignment about a generally vertical axis. The outriggers jacks 37 enable vertical movement of the carrier, and the lift assemblies 34 and 36 enable vertical movement of the upperstructure. The air pad assemblies 38 enable horizontal movement of either the carrier or the upperstructure with minimal frictional resistance.

Although the best mode contemplated for carrying out the present invention has been herein shown and described, it will be apparent that modification and variation may be made without departing from what is regarded to be the subject matter of the invention.

What is claimed is:

1. A crane upperstructure self-transferring system comprising a crane upperstructure frame having a front end and a rear end, a carrier for supporting the crane upperstructure frame, a quick disconnect turntable mounting interconnecting the carrier and the frame for rotation of the frame about a generally vertical axis, boom foot pins mounted at the front end of the frame, a front lifting assembly attachable to the frame by the boom foot pins, a counterweight mounting mechanism mounted at the rear end of the frame, a rear lifting assembly attachable to the frame by the counterweight mounting mechanism, said carrier having outrigger support jacks, and an air pad assembly positioned between a surface supporting the carrier and the outrigger support jacks enabling lateral movement of the carrier to align the carrier with the generally vertical axis of the quick disconnect turntable mounting, said front and rear lifting assemblies being operable to transfer said upperstructure frame between a position supported on said carrier and a position spaced from said carrier and supported by other means.

2. A crane upperstructure self-transferring system comprising a crane upperstructure frame having a front end and a rear end, boom foot pins mounted at the front end of the frame, a front lifting assembly attachable to the frame by the boom foot pins, a counterweight mounting mechanism mounted at the rear end of the frame, a rear liftng assembly attached to the frame by the counterweight mounting means, a live mast mounted upon the crane upperstructure frame, an auxiliary lifting sheave mounted at the distal end, of the live mast, and a load line trained about the auxiliary lifting sheave for positioning the front and rear lifting assemblies, said front and rear lifting assemblies being operable when attached to said frame to raise and lower said frame relative to a support surface.

3. A crane upperstructure self-transferring system comprising a crane upperstructure frame having a front end and a rear end, boom foot pins mounted at the front end of the frame, a front lifting assembly attachable to the frame by the boom foot pins, a counterweight mounting mechanism mounted at the rear end of the frame, a rear lifting assembly attachable to the frame by the counterweight mounting mechanism, an operator's cab mounted for vertical movement upon said crane upperstructure frame, said operator's cab being elevatable to a position that enables the front lifting assembly to be positioned beneath the operator's cab, said front and rear lifting assemblies being operable when attached to said frame to raise and lower said frame relative to a support surface.

4. A crane upperstructure self-transferring system comprising a crane upperstructure frame having a front end and a rear end, boom foot pins mounted at the front end of the frame, a front lifting assembly attachable to the frame by the boom foot pins, a counterweight mounting mechanism mounted at the rear end of the frame, a rear lifting assembly attachable to the frame by the counterweight mounting mechanism, said front lifting assembly including a pair of horizontally extending arms mounted at their proximate ends for pivotal movement about generally vertical axes between a position extending forwardly of the frame and a position extending laterally outward therefrom, each arm having a generally vertical hydraulic jack mounted at the distal end thereof, said front and rear lifting asssemblies being operable when attached to said frame to raise and lower said frame relative to a support surface.

5. A crane upperstructure self-transferring system as described in claim 4, including pins for locking the arms in the laterally outward extending position when the front lifting assembly is supporting the crane upperstructure frame.

6. A crane upperstructure self-transferring system as described in claim 4, including a hydraulic cylinder for pivoting the pair of arms between a position extending forwardly of the frame and a position extending laterally outward from the frame.

7. A crane upperstructure self-transferring system comprising a carrier, a crane upperstructure frame, a quick-disconnect mounting for interconnecting the frame to the carrier and enabling the upperstructure to rotate about a generally vertical axis, means for vertically moving the frame, means for vertically moving the carrier, and air-bearing means supporting either the carrier or the upperstructure for horizontal movement to align one with the other so that the generally vertical axis of the quick-disconnect mounting is positioned for interconnecting the frame to the carrier.

8. A crane upperstructure self-transferring system comprising a crane upperstructure frame having a front end and a rear end, a carrier for supporting the crane upperstructure frame, disconnectable turntable means mounting the frame on the carrier for rotation about a generally vertical axis, means defining front and rear lifting assemblies attachable to the front and rear ends of the frame for selectively raising and lowering the frame, and air-bearing means supporting either the upperstructure frame or the carrier for horizontal movement to align said frame and said carrier with said generally vertical axis of said turntable means for enabling interconnection of said frame and said carrier.

9. An apparatus according to claim 8 and additionally comprising a live mast mounted on the frame upperstructure frame; and an auxiliary lifting means including a sheave mounted at the distal end of the live mast, and a load line trained about the auxiliary lifting sheave for selectively engaging and moving the front and rear lifting assemblies into positions to be attached to said frame.

10. An apparatus according to claim 8 and additionally comprising an operator's cab mounted for vertical movement upon said upper structure frame, said operator's cab being elevatable to a position that enables the front lifting assembly to be position beneath the operator's cab.

* * * * *